US011633328B2

(12) United States Patent
Pallares et al.

(10) Patent No.: US 11,633,328 B2
(45) Date of Patent: Apr. 25, 2023

(54) BAG CONTAINING A BIOPHARMACEUTICAL PRODUCT AND PROBE HOLDER PORT FOR SUCH A PRODUCT

(71) Applicant: SARTORIUS STEDIM FMT SAS, Aubagne (FR)

(72) Inventors: Alain Pallares, La Bouilladisse (FR); Shuai Yi, Guangzhou (CN); Mathilde Salaun, Aubagne (FR); Andreas Prediger, Göttingen (DE); Julia Lueders, Ilsede (DE); Thomas Regen, Göttingen (DE)

(73) Assignee: SARTORIUS STEDIM FMT SAS, Aubagne (FR)

( * ) Notice: Subject to any disclaimer, the term of this patent is extended or adjusted under 35 U.S.C. 154(b) by 401 days.

(21) Appl. No.: 16/652,846

(22) PCT Filed: Sep. 26, 2018

(86) PCT No.: PCT/FR2018/000224
§ 371 (c)(1),
(2) Date: Apr. 1, 2020

(87) PCT Pub. No.: WO2019/068964
PCT Pub. Date: Apr. 11, 2019

(65) Prior Publication Data

US 2020/0230023 A1 Jul. 23, 2020

(30) Foreign Application Priority Data

Oct. 2, 2017 (FR) ..... 1771039

(51) Int. Cl.
*A61J 1/10* (2006.01)
*A61J 1/14* (2023.01)
(Continued)

(52) U.S. Cl.
CPC ..... *A61J 1/10* (2013.01); *A61J 1/1475* (2013.01); *A61J 1/18* (2013.01); *A61J 1/2058* (2015.05);
(Continued)

(58) Field of Classification Search
CPC ..... A61J 1/10; A61J 1/1475; A61J 1/1481; A61J 1/18; A61J 1/2058; A61J 2200/70; A61J 2200/72
See application file for complete search history.

(56) References Cited

U.S. PATENT DOCUMENTS 8,910,509 B2 * 12/2014 Terentiev ..... G01M 3/227 73/49.3
9,606,037 B2 * 3/2017 Kijowski ..... G01N 9/36
(Continued)

FOREIGN PATENT DOCUMENTS

DE 102004015703 A1 11/2005
WO 2013083759 A1 12/2012
WO 2015085214 A1 6/2015

OTHER PUBLICATIONS

International Search Report (and English translation) and Written Opinion of the International Searching Authority for International Application No. PCT/FR2018/000224 dated Nov. 13, 2018.
(Continued)

*Primary Examiner* — Nicolas A Arnett
(74) *Attorney, Agent, or Firm* — Heslin Rothenberg Farley & Mesiti P.C.; Victor A. Cardona, Esq.

(57) ABSTRACT

A bag for containing a biopharmaceutical product includes at least one fluid input/output port and a measurement opening remote from the fluid port. A probe holder port has a body with an axial through-bore and a peripheral collar with a second fastening zone and defining a fastening plane. A contact probe, extending in the axial through-bore, is assembled on the probe holder port, has an active measure-
(Continued)

ment end portion in contact with the product, and has an end portion opposite the end portion. The probe holder port includes a transition portion between the body and the collar, which extends between a radially central end portion of the collar and a first axial end portion of the body. The first axial end portion is the axial end portion closest to the radially central end portion of the collar. The first axial end portion is disposed on the outer side relative to the fastening plane, and the active measurement end portion is axially disposed on the outer side relative to the fastening plane.

11 Claims, 2 Drawing Sheets

(51) Int. Cl.
*A61J 1/18* (2023.01)
*A61J 1/20* (2006.01)

(52) U.S. Cl.
CPC ..... *A61J 2200/70* (2013.01); *A61J 2200/72* (2013.01)

(56) References Cited

U.S. PATENT DOCUMENTS

| | | | | |
|---|---|---|---|---|
| 10,557,811 | B2 * | 2/2020 | Furey | G01N 27/07 |
| 10,585,015 | B2 * | 3/2020 | Thenard | G01M 3/3272 |
| 2012/0065617 | A1 * | 3/2012 | Matsiev | A61M 5/142 73/61.61 |
| 2014/0083170 | A1 * | 3/2014 | Pavlik | G01M 3/3218 73/49.2 |
| 2014/0124504 | A1 * | 5/2014 | Bernard | A61J 1/2093 220/86.1 |
| 2016/0305897 | A1 * | 10/2016 | Furey | G01D 11/245 |
| 2022/0178782 | A1 * | 6/2022 | Hogreve | G01M 3/38 |

OTHER PUBLICATIONS

French Search Report for French Patent Application No. 1771039 dated Aug. 30, 2018.

English translation of the Written Opinion of the International Searching Authority for International Application No. PCT/FR2018/000224 dated Nov. 13, 2018.

* cited by examiner

FIG. 2
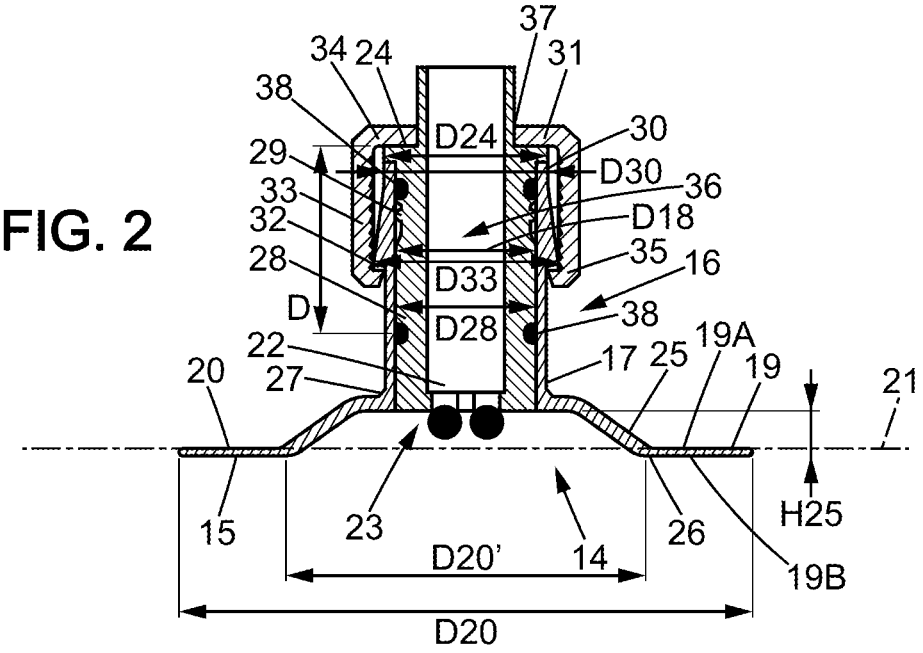
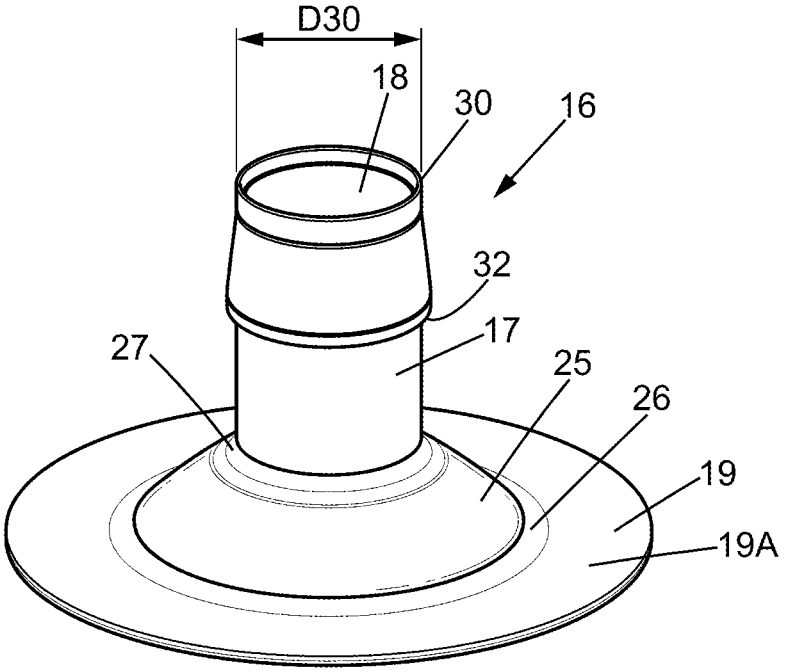
FIG. 3

BAG CONTAINING A BIOPHARMACEUTICAL PRODUCT AND PROBE HOLDER PORT FOR SUCH A PRODUCT

CROSS REFERENCE TO RELATED APPLICATIONS

This application is a national stage filing under section 371 of International Application No. PCT/FR2018/000224, filed on Sep. 26, 2018, published on Apr. 11, 2019 as WO 2019/068964 A1 which claims priority to French Patent Application No. 1771039, filed on Oct. 2, 2017. The entire disclosure of each application is hereby incorporated herein by reference.

BACKGROUND

The invention relates to a bag containing a biopharmaceutical product and a probe holder port for such a product. The invention further relates to a set intended to contain a biopharmaceutical product, comprising a bag and a probe holder port. Finally, the invention relates to an assembly intended for measuring a biopharmaceutical product, the assembly comprising, on the one hand, a set intended to contain a biopharmaceutical product, comprising a bag and a probe holder port, and on the other hand a contact probe.

The term biopharmaceutical product is understood herein to mean a product derived from biotechnology, such as culture mediums, cell cultures, buffer solutions, artificial nutrition liquids, or a pharmaceutical product, or more generally a product intended for use in the medical field. Such a product is in liquid, paste or powder form, in one or more phases, homogeneous or otherwise, capable of flowing through a valve, thus capable of being qualified as a fluid. The invention further applies to products that are not biopharmaceuticals, according to the definition given hereinabove, however which are subjected to similar requirements as regards the storage or handling thereof. In addition to the transfer of a biopharmaceutical product, the bag can be adapted for a bioreactor or a fermenter.

The contact probe is understood in this instance to be a probe for measuring parameters relative to the contents of the bag, such as pressure, pH, temperature, colorimetry, or conductimetry, etc.

In the biopharmaceutics field, bags are commonly used as a place for carrying out chemical or biological reactions, and where appropriate for monitoring and/or controlling same, or even as storage means. In order to prevent germs from penetrating the interior of the bag, it is important that the environment is sealed off, sterile and aseptic, without contact with the external surroundings.

The reactions must generally take place under determined and controlled conditions (pressure, pH, temperature, colorimetry, conductimetry, etc.) or storage must occur under controlled conditions. More or less frequent checks or measurements must thus be carried out on parameters that characterize the product contained in the bag. These measurements must be carried out under aseptic conditions for the aforementioned reasons.

In order to conduct these measurements, use of a sensor device is known. The sensor device can consist, for example, of a probe. For this purpose, the document WO 2013/083759 A1 discloses a probe used as a sensor device. The probe disclosed by the above document is a probe that can be stored dry. In such a case, the probe does not need to be stored in a buffer solution, such as potassium chloride for example. A probe capable of being stored dry thus has the advantage of being easy to store, without restrictions related to a buffer solution. This dry storage feature is particularly advantageous. In particular, it allows the set formed by the bag and the probe to be stored without a buffer solution. More specifically, the bag does not need to contain buffer solution once the probe has been assembled with the bag. However, this type of probe is delicate to handle. In particular, when assembling the probe with the bag, the measurement end of the probe, intended to be in direct contact with the biopharmaceutical product with which the bag is filled, can easily become damaged. The same is true during transport or when using the set formed by the probe and the bag.

SUMMARY OF THE INVENTION

One purpose of the invention is to propose a bag containing a biopharmaceutical product and a probe holder port for such a product that does not suffer from at least some of the drawbacks of the devices of the prior art.

According to a first aspect, the invention relates to a bag suitable for containing a biopharmaceutical product, said bag comprising:

- a flexible plastic sheath provided with at least one biopharmaceutical fluid input/output port and a measurement opening remote from the biopharmaceutical fluid input/output port, a first fastening zone surrounding said at least one measurement opening,
- a probe holder port produced in the form of a thin part, the probe holder port comprising a body provided with an axial through-bore and a peripheral flange comprising a second fastening zone and defining a fastening plane, the body extending from a side outside the flexible plastic sheath relative to the fastening plane, the first and second fastening zones being sealably assembled together by bonding or welding,
- a contact probe extending in the axial through-bore, being sealably assembled on the probe holder port, the contact probe comprising an active measurement end portion disposed in contact with the biopharmaceutical product when the bag is filled therewith, and an end portion opposite the active measurement end portion, the probe holder port comprising a transition portion between the body and the peripheral flange, extending between a radially central end portion of the peripheral flange and a first axial end portion of the body, the first axial end portion of the body being the axial end portion of the body that is closest to the radially central end portion of the peripheral flange, the first axial end portion of the body being disposed on the outer side relative to the fastening plane, the active measurement end portion being axially disposed on the outer side relative to the fastening plane.

By virtue of these dispositions, the active measurement end portion of the probe is protected from the damage that could arise when handling the probe and/or the bag.

According to one embodiment, the transition portion is conical in shape, the diameter of the transition portion on the peripheral flange side being greater than the diameter on the body side.

According to one embodiment, the height of the transition portion lies in the range 5 mm to 20 mm.

According to one embodiment, the contact probe comprises an intermediate part between the active measurement end portion and the end portion opposite the active measurement end portion, the intermediate portion comprising at least one O-ring being in sealing contact with the axial through-bore of the body.

According to one embodiment, the contact probe is assembled with the body of the probe holder port in a permanent manner.

According to one embodiment, the body comprises a second axial end portion, the second axial end portion of the body being opposite the first axial end portion of the body, and wherein the end portion opposite the active measurement end portion of the contact probe has an external diameter that is equal to the external diameter of the second axial end portion of the body.

According to one embodiment, the external diameter of the intermediate part of the contact probe is less than the diameter of the end portion opposite the active measurement end portion of the contact probe.

According to one embodiment, the diameter of the axial through-bore of the body of the probe holder port decreases from the second axial end portion of the body towards the first end portion of the body.

According to one embodiment, a locking element is disposed externally around the body and the end portion opposite the active measurement end portion of the contact probe.

According to one embodiment, the body comprises, on the external surface thereof, a circular abutment for retaining the locking element, capable of engaging with the locking element.

According to one embodiment, the locking element is cylindrical in shape and hollow and comprises an axial through-bore, the axis whereof is aligned with the axis of the axial through-bore of the body.

According to a second aspect, the invention relates to a set intended to contain a biopharmaceutical product, the set comprising a bag and a probe holder port, said bag comprising a flexible plastic sheath provided with at least one biopharmaceutical fluid input/output port and a measurement opening remote from the biopharmaceutical fluid input/output port, a first fastening zone surrounding said at least one measurement opening, the probe holder port being produced in the form of a thin part, the probe holder port comprising a body provided with an axial through-bore and a peripheral flange comprising a second fastening zone and defining a fastening plane, the body extending from a side outside the flexible plastic sheath relative to the fastening plane, the first and second fastening zones being sealably assembled together by bonding or welding, the probe holder port comprising a transition portion between the body and the peripheral flange, extending between a radially central end portion of the peripheral flange and a first axial end portion of the body, the first axial end portion of the body being the axial end portion of the body that is closest to the radially central end portion of the peripheral flange, the first axial end portion of the body being disposed on the outer side relative to the fastening plane, the active measurement end portion being axially disposed on the outer side relative to the fastening plane.

BRIEF DESCRIPTION OF THE DRAWINGS

The figures of the drawings will now be briefly described.

FIG. 2 is a perspective view of a probe holder port according to the invention.

FIG. 3 is a sectional view of a probe holder port and of a contact probe according to the invention.

DETAILED DESCRIPTION

Figure 1:
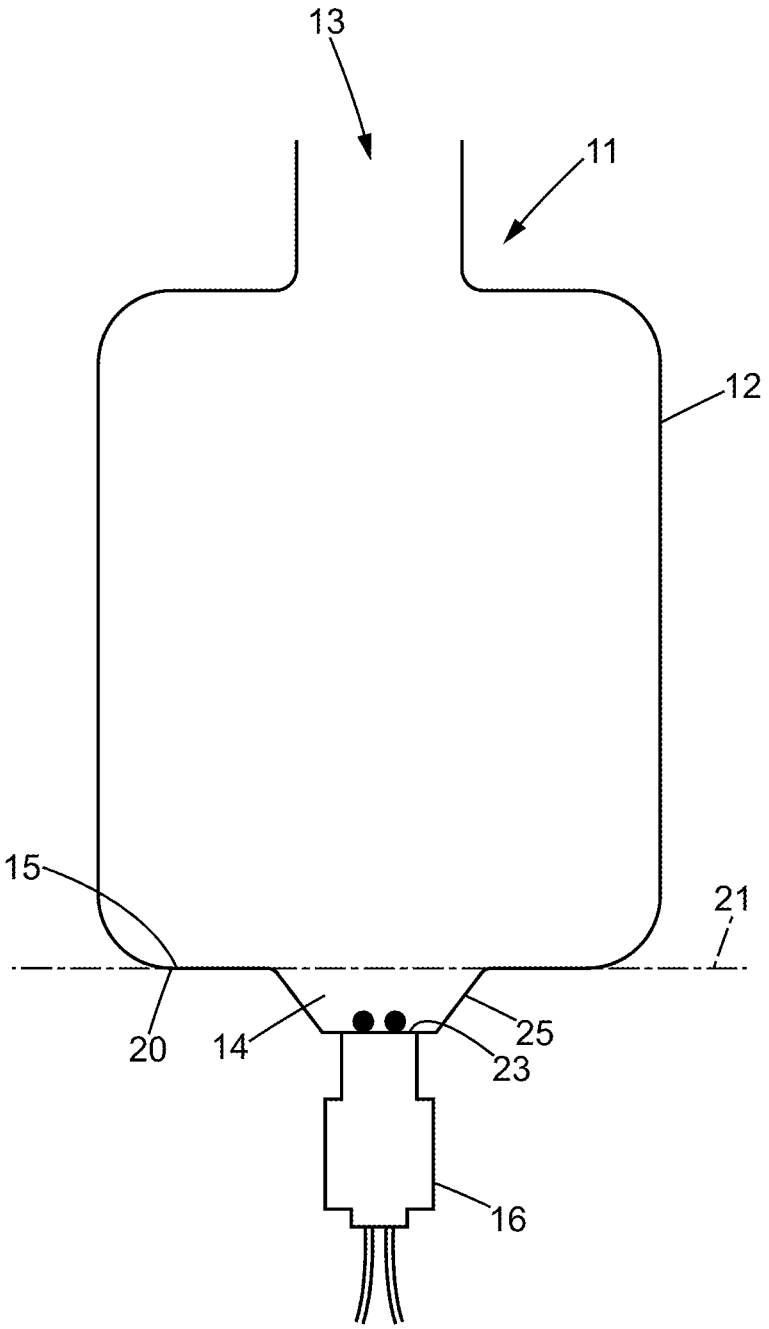
FIG. 1 is a general view of a bag containing a pharmaceutical product according to the invention.

A plurality of embodiments of the invention will be described below in detail, accompanied by examples and with reference to the drawings.

FIG. 1 shows a bag 11. Such a bag 11 is adapted to contain a biopharmaceutical product. The bag 11 comprises a flexible plastic sheath 12. The flexible plastic sheath 12 is provided with at least one input/output port 13 for the biopharmaceutical fluid. The bag 11 further comprises a measurement opening 14 and a first fastening zone 15 surrounding the measurement opening 14. The measurement opening 14 is intended for the measurement of different parameters of the biopharmaceutical product, such as the pH of the product for example. According to the invention, the measurement opening 14 is remote from the input/output port 13. In other words, the measurement opening 14 and the input/output port 13 are separate from one another.

As shown in more detail in FIG. 2, the bag 11 comprises, at the measurement opening 14, a contact probe 22 and a probe holder port 16.

The contact probe 22 is cylindrical in shape. The contact probe 22 is intended to measure a parameter of the biopharmaceutical product contained in the bag 11. For example, the contact probe 22 allows the pH of the product to be measured. The term "contact probe" is understood herein to mean a probe that requires physical contact with the product to be measured (as opposed to an optical probe for example). Other parameters can also be measured, such as the pressure, temperature or colorimetry, etc. The contact probe 22 comprises an active measurement end portion 23 and an opposite end portion 24. The opposite end portion 24 comprises an external diameter D24. For example, the external diameter D24 lies in the range 21.5 mm to 27.5 mm. According to the example shown in FIG. 2, the external diameter D24 is 24.5 mm. The active measurement end portion 23 is disposed in contact with the biopharmaceutical product when the bag 11 is filled therewith. The active measurement end portion 23 comprises, for example, two electrodes. For example, one of the two electrodes is standard and referred to as a reference electrode. The potential of this reference electrode is constant and known. The other of the two electrodes has a variable potential and is referred to as a glass electrode. The potential of this glass electrode is dependent on the pH. According to the example shown in particular in FIG. 1, the two electrodes are separate. However, the two electrodes can be combined. When the contact probe 22 is assembled with the bag 11, the active measurement end portion 23 is closer to the bag 11 than the opposite end portion 24. The contact probe 22 further comprises an intermediate part 28. The intermediate part 28 is arranged between the active measurement end portion 23 and the opposite end portion 24. The intermediate part 28 comprises an external diameter D28. For example, the external diameter D28 lies in the range 19.5 mm to 22.5 mm. According to the example shown in FIG. 2, the external diameter D28 is 20.7 mm. The external diameter D28 of the intermediate part 28 is thus less than the external diameter D24 of the opposite end portion 24. Moreover, according to the example shown in FIG. 2, the intermediate portion 28 comprises a bulge 29. According to another example, the intermediate portion 28 can comprise a plurality of bulges 29. Furthermore, the intermediate portion 28 comprises two circular grooves. The first circular groove is disposed on the same side of the bulge 29 as the active measurement end portion 23, and the second circular groove is disposed on the same side of the bulge 29 as the opposite end portion 24. Each circular groove receives an O-ring 38.

The probe holder port 16 is produced in the form of a thin part. For example, the thickness of the probe holder port 16 varies between 1 mm and 3 mm. Moreover, the probe holder port 16 is made by injection.

As shown in FIGS. 2 and 3, the probe holder port 16 comprises a body 17, a transition portion 25 and a peripheral flange 19. The body 17 has an overall cylindrical shape. The body 17 comprises, on the external surface thereof, a circular abutment 32. Moreover, the body 17 is provided with an axial through-bore 18. The axial through-bore 18 is provided for passing the contact probe 22. The contact probe 22 is thus assembled with the body 17. According to one example, the contact probe 22 is assembled with the body 17 by pouring a resin between the contact probe 22 and the body 17. According to another example, the contact probe 22 is forcibly assembled with the body 17. As a result, it is difficult to separate the contact probe 22 from the probe holder port 16 once the contact probe 22 has been assembled with the body 17. The bulge 29 of the contact probe 22 as well as the O-rings 38 are in sealing contact with the axial through-bore 18. This axial through-bore 18 extends between a first axial end portion of the body 27 and a second axial end portion of the body 30. The first axial end portion of the body 27 is the axial end portion closest to the active measurement end portion 23 of the contact probe 22 when the contact probe 22 is inserted into the probe holder port 16. The second axial end portion of the body 30 is opposite the first axial end portion of the body 17. Moreover, the second axial end portion of the body 30 comprises an external diameter D30. The external diameter D30 is identical to the diameter D24 of the opposite end portion 24 of the contact probe 22. This results in the external surfaces of the second axial end portion of the body 30 and of the opposite end portion 24 of the contact probe 22 being flush. For example, the external diameter D30 lies in the range 21.5 mm to 27.5 mm. According to the example shown in FIG. 2, the external diameter D30 is 24.5 mm. Furthermore, the axial through-bore 18 comprises a diameter D18. The diameter D18 lies in the range 18 mm to 25 mm. More specifically, the diameter D18 is not constant over the entire length of the axial through-bore 18. Indeed, the diameter D18 decreases from the second axial end portion of the body 30 towards the first axial end portion of the body 27. For example, the gap measured between the two end portions 27 and 30 is 1.4 mm. According to another example, at a distance D of 30 mm, measured from the second axial end portion 30 towards the first axial end portion 27, the surface of the axial through-bore is inclined 2.3° towards the second axial end portion 30. Moreover, the surface of the axial through-bore is inclined 0.5° towards the first axial end portion 27. This decrease in particular eases the assembly of the contact probe 22 with the probe holder port 16.

Moreover, the peripheral flange 19 extends perpendicularly relative to the body 17. It comprises a first surface 19A and a second surface 19B. The first surface 19A is oriented towards the body 17 side. The second surface 19B is opposite the first surface 19A. Moreover, the peripheral flange 19 comprises a second fastening zone 20. The second fastening zone 20 defines a fastening plane 21. This second fastening zone 20 is circular, with an external diameter D20 and an internal diameter D20'. The external diameter D20 lies in the range 80 mm to 90 mm. For example, the external diameter D20 is 85 mm. The internal diameter D20' lies in the range 52 mm to 57 mm. For example, the internal diameter D20' is 54.4 mm. The internal diameter D20' limits the radially central end portion 26 of the peripheral flange 19. According to one example shown in FIG. 2, the second fastening zone 20 corresponds to the first surface 19A. According to another example, not shown, the second fastening zone 20 can correspond to the second surface 19B. Moreover, the second fastening zone 20 is intended to be in contact with the first fastening zone 15 of the bag 11. The first and second fastening zones 15, 20 are sealably assembled together. For example, the first and second fastening zones 15, 20 are assembled together by bonding or welding. Preferentially, the assembly between the first and second fastening zones 15, 20 takes place by welding. As opposed to bonding, welding prevents contamination from potentially entering the bag 11 as a result of the bonding agent. According to the example shown in FIG. 2, the flexible plastic sheath 12 is welded onto the first surface 19A of the flange 19. The probe holder port 16 is thus firmly and sealably fastened to the bag 11. Once the probe holder port 16 has been assembled with the bag 11, the fastening plane 21 defines a side outside the bag 11 and an inner side. As a result, the biopharmaceutical product present in the bag 11 extends from the inner side relative to the fastening plane 21 whereas the probe holder port 16 extends from the outer side relative to the fastening plane 21, in its entirety when the second fastening zone 20 corresponds to the second surface 19B, or almost in its entirety when the second fastening zone 20 corresponds to the first surface 19A.

The transition portion 25 is disposed between the body 17 of the probe holder port 16 and the peripheral flange 19. More specifically, the transition portion 25 extends between the radially central end portion 26 of the peripheral flange 19 and the first axial end portion of the body 27. As shown in FIGS. 2 and 3, this transition portion 25 is conical in shape. A conical shape has the advantage of doing away with sharp edges, which could cause deterioration to the flexible plastic sheath 12 of the bag 11. Moreover, the transition portion 27 is dimensioned so as to allow for good circulation of the biopharmaceutical product inside the cone-shaped portion. Good circulation of the pharmaceutical product thus prevents the measurements taken by the contact probe 22 from being distorted. The diameter of the transition portion 25 is larger on the fastening plane 21 side than on the first axial end portion of the body 27 side. Moreover, the shape of the transition portion 27 allows the contact probe 22 to be protected from the different degradations that it could suffer, in particular as a result of transport or use of the bag 11, or even during the step of assembling the contact probe 22 with the bag 11, the bag 11 being previously equipped with the probe holder port 16. Furthermore, the height H25 of the transition portion 25 lies in the range 5 mm to 20 mm. For example, the height H25 lies in the range 9.7 mm to 10.3 mm. According to another example, the height H25 is 10 mm. The height H25 is measured between the plane 21 and the first axial end portion of the body 27, at the axial through-bore 18. The first axial end portion of the body 27 is thus remote from the plane 21. As a result, the active measurement end portion 23 of the contact probe 22 is remote from the plane 21. The height H25 thus allows the active measurement portion 23 to be distanced from the plane 21. Owing to the shape of the transition portion 25, the addition of a protective element around the contact probe 22 to protect it from damage is not necessary. The probe holder port 16 thus allows the contact probe 22 to be protected while retaining a simple configuration. Moreover, the probe holder port 16 facilitates the assembly of the contact probe 22 and also protects it during the step of assembling the contact probe 22 in the probe holder port 16. More specifically, the probe holder port 16 is previously assembled with the bag 11. For example, the probe holder port 16 is inserted into the bag 11. The probe holder port 16 is then passed through the measurement opening 14. Thus, the body 17 and the transition portion 25 extend on the outer side of the bag 11 and the flange extends on the inner side of the bag 11. The first and second fastening zones 15, 20 are then assembled together. The operator then places the bag 11 flat on a hard support, for example a table, ensuring that the flange 19 is laid flat relative to the support. The operator then inserts the contact probe 22 into the probe holder port 16. The dedicated shape of the probe holder port 16 prevents the measurement end 23 of the contact probe 22 from being deteriorated through contact with the flexible plastic sheath 12 of the opposite bag 11 resting on the support. Thus, the operator can exert a force that slightly exceeds that required to insert the contact probe 22 into the probe holder port 16 without the risk of deteriorating the former. The assembly operation is thus made secure and easier for the operator, who does not need to pay particular attention thereto. This assembly operation is thus also faster and contributes to improving the production of the bag 11.

Moreover, as shown in FIG. 2, the bag 11 comprises a locking element 31. The locking element 31 contributes to the assembly of the contact probe 22 with the probe holder port 16. For example, the locking element 31 is held by snap fitting around the body 17 of the probe holder port 16. The locking element 31 comprises a cylindrical portion 33, a first end portion 34 and a second end portion 35. The locking element 31 is disposed externally around the body 17 and the end portion 24 opposite the active measurement end portion 23 of the contact probe 22. More specifically, the cylindrical portion 33 surrounds the body 17 and the end portion 24. More specifically, the cylindrical portion 33 comprises an axial through-bore 36. The axis of the axial through-bore 36 is aligned with the axis of the axial through-bore 18 of the body 17. The cylindrical portion 33 further comprises an internal diameter D33. The first end portion 34 extends radially to the cylindrical portion 33. The first end portion 34 is disposed in contact with the opposite end portion 24 of the contact probe 22. The first end portion 34 further comprises an opening 37. The opening 37 is capable of allowing the connection elements linked to the contact probe 22 to pass therethrough. The second end portion 35 extends radially to the cylindrical portion 33. The second end portion 35 engages with the circular abutment 32 of the body 17 of the probe holder port 16. The circular abutment 32 holds the locking element 31 in position around the contact probe 22 and the probe holder port 16.

The invention is not limited solely to the examples described hereinabove, but can be the subject of numerous alternative embodiments accessible to a person skilled in the art. For example, although the description hereinabove refers to a contact probe, the probe holder port can be adapted to any measuring device such as optical sensors, temperature sensors, or pressure sensors for example.

The invention claimed is:

1. A bag adapted to contain a biopharmaceutical product, said bag comprising:

a flexible plastic sheath provided with at least one biopharmaceutical fluid input/output port and a measurement opening remote from the biopharmaceutical fluid input/output port, a first fastening zone surrounding said at least one measurement opening;

a probe holder port produced in the form of a thin part, the probe holder port comprising a body provided with an axial through-bore and a peripheral flange comprising a second fastening zone and defining a fastening plane, the body extending from a side outside the flexible plastic sheath relative to the fastening plane, the first and second fastening zones being sealably assembled together by bonding or welding;

a contact probe extending in the axial through-bore, being sealably assembled on the probe holder port, the contact probe comprising an active measurement end portion disposed in contact with the biopharmaceutical product when the bag is filled therewith, and an end portion opposite the active measurement end portion, the probe holder port comprising a transition portion between the body and the peripheral flange, the transition portion extending between a radially central end portion of the peripheral flange and a first axial end portion of the body said transition portion having a circumferentially continuous conical inner surface defining a cavity facing the at least one measurement opening and being axially disposed on an outer side relative to the fastening plane, the first axial end portion of the body being the axial end portion of the body that is closest to the radially central end portion of the peripheral flange, the first axial end portion of the body being disposed on the outer side relative to the fastening plane, the active measurement end portion being axially disposed on the outer side relative to the fastening plane.

2. The bag according to claim 1, wherein, the height of the transition portion lies in the range 5 mm to 20 mm.

3. The bag according to claim 1, wherein the contact probe comprises an intermediate part between the active measurement end portion and the end portion opposite the active measurement end portion, the intermediate portion comprising at least one O-ring being in sealing contact with the axial through-bore of the body.

4. The bag according to claim 1, wherein the contact probe is assembled with the body of the probe holder port in a permanent manner.

5. The bag according to claim 4, wherein the body comprises a second axial end portion, the second axial end portion of the body being opposite the first axial end portion of the body, and wherein the end portion opposite the active measurement end portion of the contact probe has an external diameter that is equal to the external diameter of the second axial end portion of the body.

6. The bag according to claim 5, wherein the external diameter of the intermediate part of the contact probe is less than the diameter of the end portion opposite the active measurement end portion of the contact probe.

7. The bag according to claim 1, wherein the diameter of the axial through-bore of the body of the probe holder port decreases from the second axial end portion of the body towards the first end portion of the body.

8. The bag according to claim 1, wherein a locking element is disposed externally around the body and the end portion opposite the active measurement end portion of the contact probe.

9. The bag according to claim 8, wherein the body comprises, on an external surface thereof, a circular abutment for retaining the locking element, capable of engaging with the locking element.

10. The bag according to claim 9, wherein the locking element is cylindrical in shape and hollow and comprises a second axial through-bore, on the axis of said second axial through-bore aligned with the axis of the axial through-bore of the body.

11. An assembly intended to contain a biopharmaceutical product, the assembly comprising a bag and a probe holder port, said bag comprising a flexible plastic sheath provided with at least one biopharmaceutical fluid input/output port and a measurement opening remote from the biopharmaceutical fluid input/output port, a first fastening zone surrounding said at least one measurement opening, the probe holder port being produced in the form of a thin part, the probe holder port comprising a body provided with an axial through-bore and a peripheral flange comprising a second fastening zone and defining a fastening plane, the body extending from a side outside the flexible plastic sheath relative to the fastening plane, the first and second fastening zones being sealably assembled together by bonding or welding, the probe holder port comprising a transition portion between the body and the peripheral flange, the transition portion extending between a radially central end portion of the peripheral flange and a first axial end portion of the body said transition portion having a circumferentially continuous conical inner surface defining a cavity and facing the at least one measurement opening and being axially disposed on an outer side relative to the fastening plane, the first axial end portion of the body being the axial end portion of the body that is closest to the radially central end portion of the peripheral flange, the first axial end portion of the body being disposed on the outer side relative to the fastening plane, the active measurement end portion being axially disposed on the outer side relative to the fastening plane.

* * * * *